US008057193B2

(12) United States Patent
Köck

(10) Patent No.: US 8,057,193 B2
(45) Date of Patent: Nov. 15, 2011

(54) SCREW COMPRESSOR COMPRISING A RELIEF VALVE

(75) Inventor: Engelbert Köck, Planegg (DE)

(73) Assignee: Knorr-Bremse Systeme fur Schienenfahrzeugh GmbH, Munich (DE)

( * ) Notice: Subject to any disclaimer, the term of this patent is extended or adjusted under 35 U.S.C. 154(b) by 561 days.

(21) Appl. No.: 12/295,843

(22) PCT Filed: Apr. 5, 2007

(86) PCT No.: PCT/EP2007/003093

§ 371 (c)(1),
(2), (4) Date: Jan. 13, 2009

(87) PCT Pub. No.: WO2007/115787

PCT Pub. Date: Oct. 18, 2007

(65) Prior Publication Data

US 2009/0116975 A1 May 7, 2009

(30) Foreign Application Priority Data

Apr. 6, 2006 (DE) ..... 10 2006 016 318

(51) Int. Cl.

| | |
|---|---|
| ***F04B 49/00*** | (2006.01) |
| ***F04B 39/00*** | (2006.01) |
| ***F04B 23/00*** | (2006.01) |
| ***F04B 41/00*** | (2006.01) |
| ***G05D 11/00*** | (2006.01) |

(52) U.S. Cl. ..... 417/307; 417/296; 417/306; 417/309; 417/310; 417/440; 417/435; 137/115.13

(58) Field of Classification Search ..... 417/283, 417/296, 299, 306–307, 309–310, 440, 435; 137/12, 42, 115.13, 115.18, 458

See application file for complete search history.

(56) References Cited

U.S. PATENT DOCUMENTS 3,581,760 A * 6/1971 West ..... 137/115.13

(Continued)

FOREIGN PATENT DOCUMENTS

DE 2944053 5/1981

(Continued)

OTHER PUBLICATIONS

English Translation of the International Preliminary Examination Report for PCT Patent Application PCT/EP2007/003093, dated Apr. 5, 2007.

*Primary Examiner* — Nimeshkumar Patel
*Assistant Examiner* — Jose M Diaz
(74) *Attorney, Agent, or Firm* — Barnes & Thornburg LLP

(57) ABSTRACT

A compressor arrangement includes a compressor housing, an intake region defined in the compressor housing, a control pressure connection in communication with the intake region, a control pressure chamber in communication with the control pressure connection, a control piston disposed in the compressor housing beneath the control pressure chamber, a guide element securing the control piston in the compressor housing, at least one sealing element disposed between the control piston and the guide element, and a feed pressure connection defined in the compressor housing to supply compressed air beneath the control piston. In a closed position, the control piston closes the feed pressure connection when in the closed position. In an opened position, the control piston opens the feed pressure connection when in the opened position, thereby permitting air to vent from the feed pressure connection via a venting connection.

12 Claims, 2 Drawing Sheets

U.S. PATENT DOCUMENTS

| | | | | |
|---|---|---|---|---|
| 4,147,475 | A | 4/1979 | Shoop et al. | |
| 4,270,885 | A * | 6/1981 | Shaffer et al. | 417/279 |
| 5,584,673 | A | 12/1996 | Rein | |
| 5,694,966 | A * | 12/1997 | Holder | 137/115.11 |
| 5,797,732 | A * | 8/1998 | Watanabe et al. | 417/310 |
| 5,832,737 | A * | 11/1998 | Moilanen | 62/228.5 |
| 5,979,168 | A * | 11/1999 | Beekman | 62/228.5 |
| 2002/0035839 | A1 | 3/2002 | Sjoholm et al. | |
| 2002/0144511 | A1 | 10/2002 | Monk et al. | |
| 2004/0256005 | A1 * | 12/2004 | Kayukawa | 137/115.13 |

FOREIGN PATENT DOCUMENTS

| | | | |
|---|---|---|---|
| DE | 42 28 945 | A1 | 3/1994 |
| EP | 0 586 949 | B1 | 3/1994 |
| EP | 0 681 105 | | 11/1995 |
| EP | 0 684 385 | A1 | 11/1995 |
| GB | 2 041 450 | A | 9/1980 |
| JP | 2005 147511 | | 6/2005 |

* cited by examiner

SCREW COMPRESSOR COMPRISING A RELIEF VALVE

CROSS-REFERENCE TO RELATED APPLICATION(S)

This application is a National Phase Application based on and claiming the benefit of priority to PCT/EP2007/003093, filed on Apr. 5, 2007, and to German Application No. DE 10 2006 016 318.4, filed on Apr. 6, 2006, the contents of both of which are incorporated herein by reference.

FIELD OF THE INVENTION

The present invention relates to a compressor arrangement. More particularly, the present invention relates to a screw compressor for compressed air generation, with a compressor housing which has an intake region, a feed pressure connection for delivering the compressed pressure medium, and a device for venting the feed pressure connection.

DESCRIPTION OF RELATED ART

DE 29 44 053 C2 discloses an intake control device for a compressor, in particular for a screw compressor with oil injection. In this case, after the compressor is switched off, the operating pressure is built up by means of the bore in the closing piece. The bore is connected, in the closing position, to the line carrying the operating pressure. A non-return valve, usually present in a screw compressor with oil injection, which prevents an escape of oil from the oil reservoir after the compressor is switched off, is excluded from the described device. The pressure face on the control piston is contradirectional to the spring force. Due to the connection of the pressure face to the line carrying the operating pressure, when the compressor is started up, the closing piece is opened, via a bore of small cross section, in cooperation with the action of the pressure on the suction side upon the opposite piston face. Subsequently, after an interruption in the venting line, even a relatively low operating pressure is sufficient to bring the closing piece into the fully open position. By the network pressure acting upon the control piston in the closing direction, a proportional control is finally achieved, the network pressure counteracting the operating pressure on the opposite pressure face on the piston.

It is known, particularly in screw compressors with a low delivery quantity, for relief valves to fail to provide complete relief to the ambient pressure. Instead, relief according to the pressure occurs, which is sufficient for the functioning of the valve, in particular for the required spring pressure in the valve.

The problem arises, here, that further relief takes place solely via a nozzle. A nozzle presents significant disadvantage in that it causes a permanent loss of compressed air during the operation of the compressor. As a result, the available delivery quantity of the compressed air is reduced. Moreover, the nozzle tends to become blocked, since it is designed to be as small as possible in order to limit the abovementioned delivery quantity loss. The latter, in turn, leads to relatively long relief sides to ambient pressure. A further disadvantage of the known relief valves, particularly during use in the rail vehicle sector and other mobile applications, such as, for example, buses, becomes apparent at temperatures of −25° C. or less. In terms of the field of use mentioned, however, temperatures down to −40° C. are sometimes must be tolerated. It has to be remembered that, in contrast to a venting valve, for example in a tank, relief in screw compressors occurs only in the event of switch-off and then only on the compressed air side already freed of oil. The compressed air side is necessary for environmental protection reasons, but particularly also to ensure that the oil lasts, undiminished, for as long as possible. The oil is absolutely necessary to operation of the apparatus. A simple spring-loaded non-return valve or an overflow valve can be used for this reason. Moreover, known systems have a complicated set-up, since they are spring-loaded and often require an external control of the valve position.

SUMMARY OF THE INVENTION

The present invention, therefore, provides a device for venting in a compressor arrangement, allows a complete venting of the feed pressure connection after the switch-off of the compressor arrangement, has a simple set-up (i.e., construction), and automatically executes the required switching operation.

The invention provides a compressor arrangement with characteristics and features that are discussed in the description and shown in the illustrations that follow.

The invention includes a springless relief valve having a control piston which, when the compressor arrangement is in operation, assumes a first switching position to close the feed pressure connection against at least one sealing element. When the compressor arrangement is in the switched-off state, the control piston can be acted upon by means of a rise in pressure in the intake region via a control pressure connection communicating with the intake region. When acted upon by a rise in pressure, the compressor arrangement assumes a second switching position in which the feed pressure connection is vented via a venting connection.

The relief valve according to the invention is distinguished in that it does not require either a return spring or an external control. Moreover, no nozzle is required, and the venting of the feed pressure side takes place in a short time solely via the relief valve. It may be gathered from the proposed device for venting the feed pressure connection that the valve causes minor delivery quantity losses merely during the short switching operation for closing, but not during operation. This means that, particularly in smaller compressors in which any further delivery quantity loss is particularly noticeable, the complete delivery quantity of the compressor is available to the at least one consumer without restriction. A "consumer" encompasses, among other things, a device that receives or consumes the compressed air.

Furthermore, there is the advantage of an extremely small number of parts and of a simple embodiment of the relief valve with correspondingly arranged sealing elements, thus lowering the outlay in terms of production, storage and assembly times. The latter is also achieved by means of a simple mounting of the valve, which merely has to be introduced and fastened. Furthermore, particularly in applications in the mobile sector, impurities and the incidence of water are critical factors. In operation, the axial sealing seat of the valve appreciably reduces the possibility of dirt deposits or water accumulation, particularly since air also flows completely over the counterface during each switching operation. The reduction in the incidence of water plays an important part particularly at low temperatures and constitutes critical protection against the freezing-up of, in particular, the sealing points.

By eliminating the need for a return spring for moving the control piston, the operational reliability of the relief valve rises, since a fatigue or a direct failure of the spring no longer has to be considered. Furthermore, dispensing with this spring affords the advantage that no spring force has to be overcome, which would result in corresponding switching delays, pressure losses or incomplete pressure relief.

The control piston has two switching positions, the first switching position being present when the compressor arrangement is in operation (i.e., an opened position) and the second switching position being present in the switched-off state (i.e., a closed position). When the compressor is operating normally, the air is forced with excess pressure out of the compressor housing from the clean side of the air/oil separation element through the feed pressure connection onto an annular feed pressure face. As a result, the control piston closes the feed pressure connection against the sealing element. As long as the operation of the compressor is maintained, the control piston remains in the first switching position. In the first switching position, the control pressure connection communicates fluidically with the the intake region and a considerably lower pressure of the corresponding pressure medium prevails than in the feed pressure connection.

Advantageously, opposite to the feed pressure face, an annular control pressure face is formed on the control piston and can be acted upon via the control pressure connection, the control piston assuming the second switching position by the action of pressure upon the control pressure face. This second switching position is reached as soon as the compressor is switched off. In this case, the compressed air mixed with oil is forced back into the intake region, so that the control pressure connection is likewise acted upon with pressure. A non-return valve in this case ensures that the pressure in the intake region is maintained, so that the control piston is acted upon with pressure, via the control pressure face, and assumes the second switching position. The sealing element is therefore released, so that the air can flow out from the clean side, that is to say from the feed pressure connection, via the relief valve.

In this case, the control piston is advantageously designed in such a way that the control pressure face is larger than the feed pressure face, so that, in the case of an approximately equal pressure of the feed pressure in the feed pressure connection and of the control pressure in the control pressure connection, the control piston assumes the second switching position. The switching movement of the control piston thus becomes possible only in that the effective faces are of different size, since housing pressure prevails both at the feed pressure connection and at the control pressure connection. After switching has taken place, the compressor is vented to ambient pressure on the side of the feed pressure connection.

When the compressor is put into operation again, air continues to flow out for a short time via the relief valve. However, the pressure in the feed pressure connection is built up more quickly than it can flow out via the relief valve. Simultaneously, after the opening of the non-return valve, a slight vacuum is generated in the intake region. After a short time, the control piston moves back into the first switching position again, so that it lies once again on the sealing element and closes the valve.

For structural reasons, it is particularly advantageous that the relief valve is received directly by the housing of the compressor arrangement, the housing forming the valve seat. The control piston is in this case annular, and a guide element extends coaxially through the control piston. The guide element is capable of being screwed in via a thread in the housing and receiving the sealing element. Advantageously, in this case, the relief valve is not designed as an individual part, but is integrated directly in the housing of the compressor arrangement. The geometric design of the valve seat comprises a plurality of concentric bores which are arranged coaxially to one another in such a way that they can be manufactured, preferably by drilling, from one machining direction.

The guide element is of screw-like design and comprises a cylindrical guide portion and a screw shank portion, so that the latter can be screwed into a thread. Therefore, either the guide portion or the screw shank portion can be screwed in a permanently defined manner until it stops or can have a varied screw-in depth. The part of the guide element which forms the valve component has correspondingly machined outer round faces. Furthermore, this guide element receives the sealing element against which the control piston forms a seal in the first switching position. At the same time, via an outer cylindrical face, the guide element serves for guiding the annular piston. The annular piston moves axially over its stroke length via the guide element. The control piston is, in this case, provided with radially running bores which form venting ducts between the annular gap and the venting connection. The annular gap is designed as a venting cross section between the control piston and the guide element. In the second switching position, in which the annular piston releases an annular flow cross section for venting with respect to the sealing element, the pressure medium can then be vented out of the feed pressure connection via the annular gap between the guide element and the annular piston through the radial bores into a venting connection. The venting connection preferably leads into the intake filter of the compressor, since the pressure medium may be laden with oil and, therefore, does not pass into the atmosphere.

For structural reasons, it is particularly advantageous that the bores forming the valve seat are closed outwardly by means of a closing element. The closing element may be arranged releasably in the housing. Furthermore, the closing element in this case includes a seal to provide a pressure tight closure with respect to the outside or the housing of the compressor. The closing element may be designed as a lid-shaped plate which is arranged by means of a spring ring in a corresponding bore or a groove. The closing element also may be designed as a screw-in lid or as a closing element which is fastened, pressure-tight, to the housing by means of a plurality of individual connection elements. The need for the closing element arises particularly from the manufacture of the valve seat, since the individual contours in the housing have to be generated from a machining direction leading from outside the housing, and therefore a pressure-tight closure is subsequently required.

BRIEF DESCRIPTION OF THE DRAWINGS

Further measures which improve the invention are specified in the description or are illustrated in more detail below, together with the description of a preferred exemplary embodiment of the invention, by means of the figures in which.

DETAILED DESCRIPTION OF EMBODIMENT(S) OF THE INVENTION

One or more embodiments of the invention will now be described in greater detail. The embodiment(s) described is(are) intended to be exemplary of the invention. There are numerous equivalents and variations of the embodiment(s) described that should be appreciated by those skilled in the art. Those equivalents and variations are intended to be encompassed by the scope of the invention.

Figure 1:
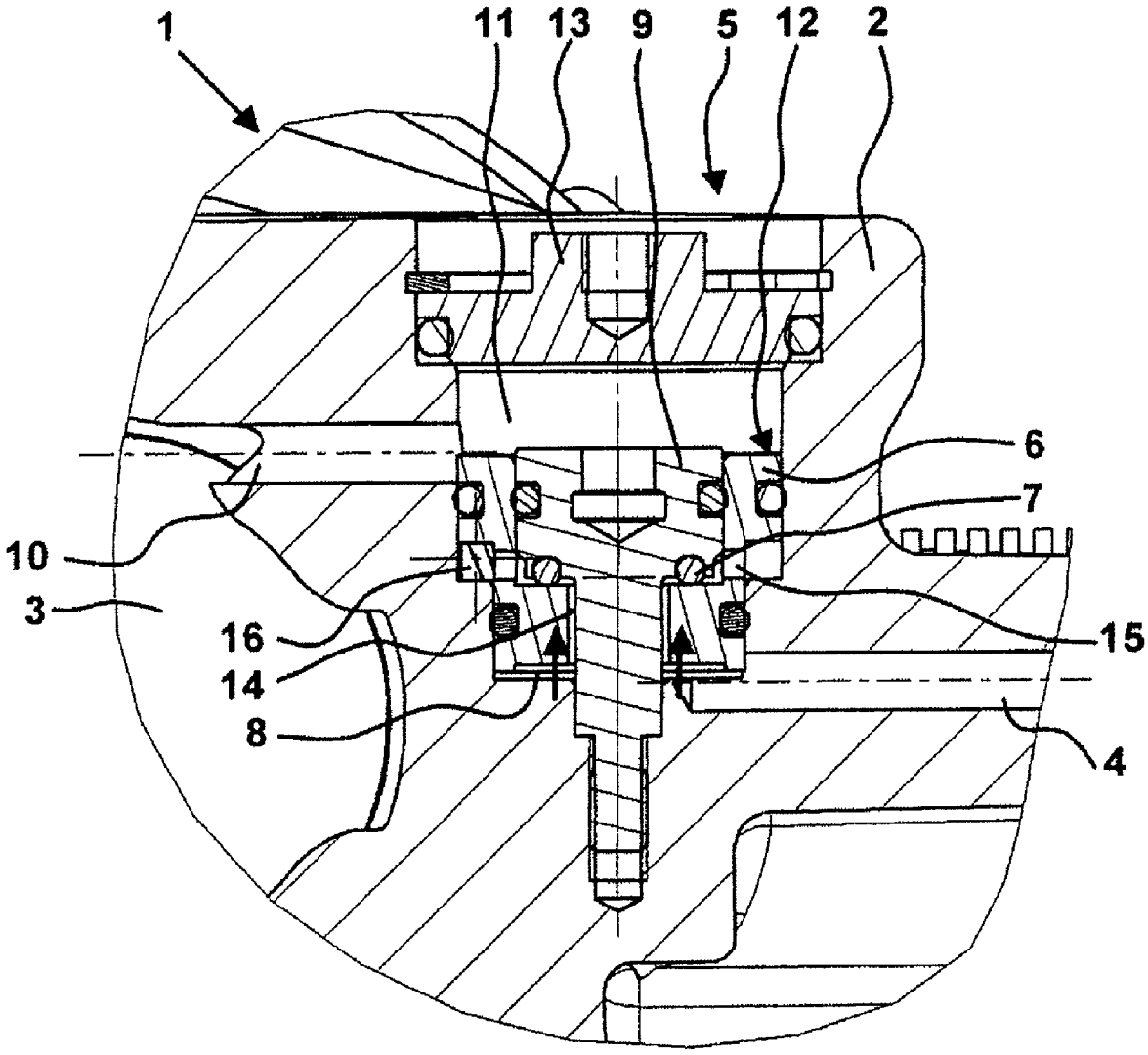
FIG. 1 shows a detail of a compressor arrangement with a sectional view of a relief valve, the control piston being in a first switching position.

The compressor arrangement 1 illustrated in FIG. 1 comprises, firstly, a compressor housing 2 having an intake region 3 through which the air to be compressed is drawn via suction. This is supplied as feed pressure air to the corresponding consumers, the feed pressure likewise prevailing in the feed pressure connection 4. As noted above, consumers refers to components that utilize the air for operation, among other things.

A relief valve 5 is illustrated in the sectional plane, the relief valve 5 being in a first switching position. The relief valve 5 serves for venting the feed pressure connection 4 when the compressor arrangement 1 is put out of operation (i.e., is not in operation). The feed pressure connection 4 is in this case connected to the clean side of the air/oil separation element and, during operation, has a housing excess pressure, this excess pressure being lowered to ambient pressure by means of the relief valve when the compressor arrangement 1 is switched off.

The relief valve 5 illustrated includes, furthermore, a control piston 6 which is in the first switching position. In this case, the control piston 6 seals off the feed pressure connection 4 against a sealing element 7. During operation, the feed pressure in the feed pressure connection 4 has a pressure which is higher than the ambient pressure. The feed pressure acts upon a feed pressure face 8, so that the control piston 6 moves upwards in the image plane. The control piston 6 is of an annular design, a sealing face being arranged such that, during an upward movement of the control piston 6, the sealing face moves against the sealing element 7 and, thereby, forms a seal. The feed pressure connection 4 is consequently closed, in a pressure-tight fashion, since it is likewise sealed off by means of a sealing element in the lower region of the control piston 6 on the outside against the valve seat in the compressor housing 2.

A guide element 9 runs coaxially through the annular control piston 6. The control piston 6 is screwed in a threaded bore in the lower region of the valve seat in the housing 2, so that the guide element 9, in the vertical position, either can be screwed in a permanently defined manner until it stops or can be arranged variably as a function of the screw-in depth. The more deeply the guide element 9 is screwed in the compressor housing 2, the smaller the possible stroke movement of the control piston 6 becomes. In the case of a large stroke movement, the possible flow cross section for venting the feed pressure connection 4 is correspondingly larger. The sealing element 7 is received in the guide element 9 and is designed as an O-ring seal. Between the control piston 6 and the guide element 9, and also between the control piston 6 and the valve seat in the compressor housing 2, further sealing elements are arranged, which are likewise designed as O-ring seals. The intake region 3 is connected to the relief valve 5 via a control pressure connection 10, a control pressure chamber 11 being formed above the control piston 6. Since, when the compressor arrangement 1 is in operation, the pressure in the intake region 3, and consequently in the control pressure chamber 11, is low and corresponds approximately to the ambient pressure, the control piston 6 remains in the first position and seals off the feed pressure connection 4 against the sealing element 7. Two arrows depicted next to the shank portion of the guide element 9 indicate the movement direction or holding direction of the control piston 6 in the first switching position.

The relief valve 5 is introduced in the compressor housing 2, the compressor housing 2 itself forming the valve seat. The relief valve 5 is constructed essentially from two components which correspond merely to the control piston 6 and to the guide element 9. These components are received in the valve seat, the latter being formed from concentrically arranged bore portions so that the machining of the bore portions can take place from one machining direction.

Above the control piston 6 and the guide element 9 of the relief valve 5, a closing element 13 is inserted which closes off, in a pressure-tight fashion, the control pressure chamber 11. According to the present exemplary embodiment, the closing element 13 is designed as a circular lid which seals off against the housing 2 of the compressor arrangement 1 by means of an O-ring. To secure the closing element 13, the latter is fixed axially in the reception bore by means of a securing ring. In order to remove the closing element 13, the latter has a central bore into which a thread can be screwed in order to pull out the closing element 13 from the bore during demounting (i.e., during removal).

Figure 2:
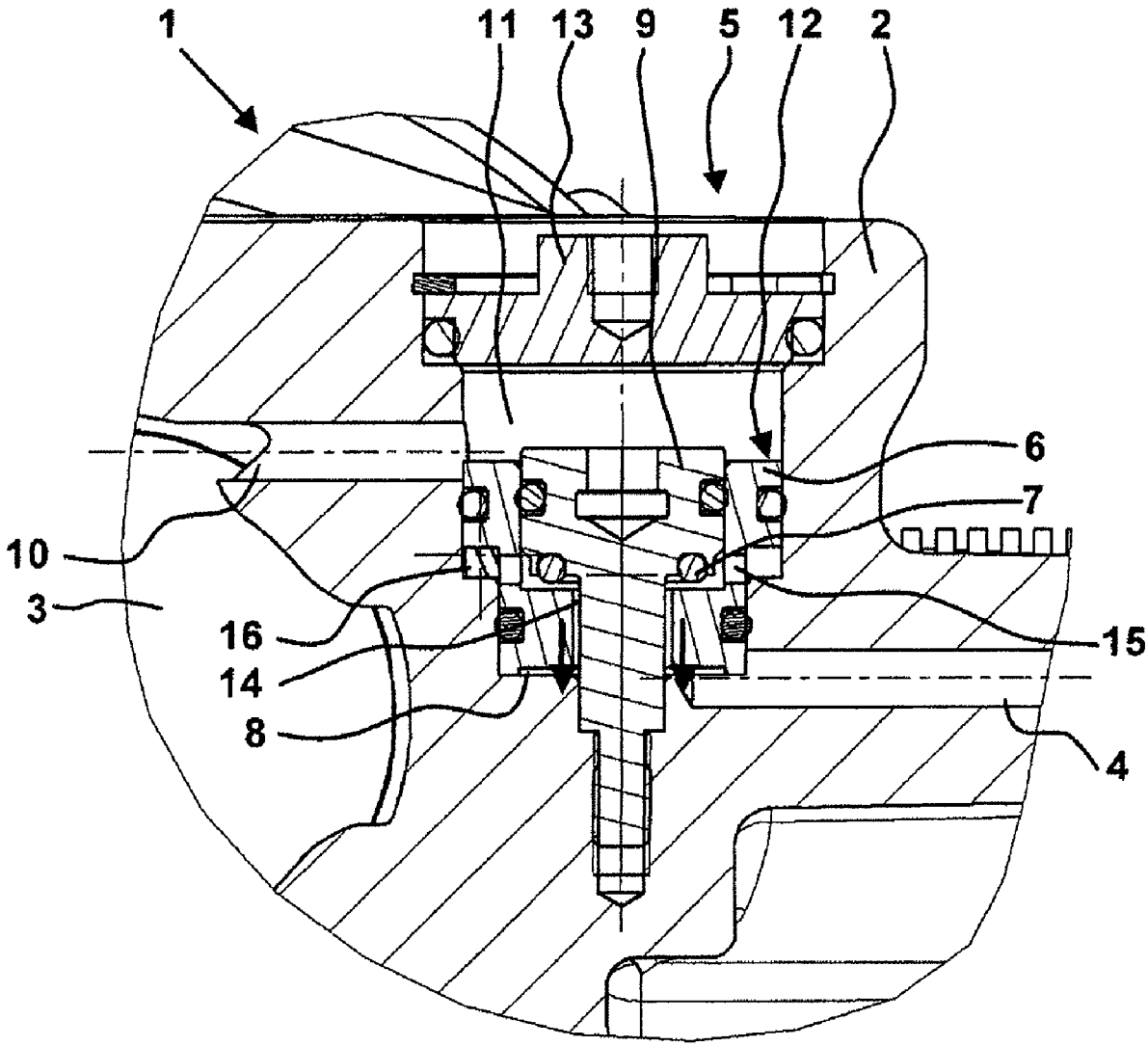
FIG. 2 shows a detail of a compressor arrangement with a sectional view of a relief valve, the control piston being in a second switching position.

FIG. 2 shows the compressor arrangement 1 with a sectional view of a relief valve 5, the control piston 6 being in a second switching position. This second switching position corresponds to the switched-off state of the compressor, thus making it necessary to vent the feed pressure connection 4 at ambient pressure. When the compressor 1 is switched off, the pressure in the feed pressure connection 4 falls slightly, since the compressed air is forced back into the intake region 3. Thus, via the control pressure connection 10, the pressure in the control pressure chamber 11 is increased, so that the control pressure face 12 is acted upon with a higher pressure. The control pressure face 12 is designed to be larger than the feed pressure face 8, which results in a vertical movement of the control piston 6 downwards, so that the sealing element 7 is released from the sealing face of the control piston 6 and the feed pressure connection 4 is vented. On the assumption of pressure equality in the feed pressure connection 4 and in the control pressure connection 10 in the switched-off state, the control piston 6 remains in the second position, since the control pressure face 12 is larger than the feed pressure face 8, so that the axial force acting on the control piston 6 and directed vertically downwards is higher than the force which is directed upwards via the feed pressure face 8. Two arrows depicted next to the shank portion of the guide element 9 indicate the movement direction and the holding direction of the control piston 6 in the second switching position.

The venting of the feed pressure connection 4 takes place, firstly, via an annular gap 14 which extends vertically between the guide element 9 and the control piston 6. The bore through which the guide element 9 runs is designed with a larger diameter than the shank of the guide element 9. Since the sealing element 7 then does not bear on the sealing face of the control piston 6, the pressure from the feed pressure connection 4 escapes first via the annular gap 14 through radial bores 15, which are located within the control piston 6 in order to connect the inside of the control piston 6 fluidically to a venting connection 16. The venting connection 16 may, in this case, be connected to the intake filter of the compressor arrangement in order to vent into the filter. In this case, advantageously, the air which is possibly still contaminated slightly with oil can be purified, so that the oil from the lubrication of the screw compressor cannot pass into the surroundings (i.e., the environment).

The switching movement of the control piston becomes possible, in the event of pressure equality between the feed pressure connection 4 and the intake region 3, in that the effective faces are of different size, so that the venting position according to FIG. 2 is maintained even when the compressor is vented to ambient pressure after switching has taken place. When the compressor is put into operation again, air continues to flow for a short time via the feed pressure connection 4, the annular gap 14 and the radial bores 15 into the venting connection 16. However, since air is conveyed in more quickly than it can flow out, and, simultaneously, after the opening of the non-return valve, a slight vacuum is generated in the intake region 3, after a short time the control piston 6 moves upwards again and once more forms a seal against the sealing element 7. Thus, the valve is closed again, and the compressor can be operated without a valve-induced pressure loss.

Other variations and equivalents of the invention should be apparent to those skilled in the art. Those variations and equivalents are intended to fall within the scope of the invention.

The invention claimed is:

1. A compressor arrangement, comprising:

a compressor housing;

an intake region defined in the compressor housing;

a control pressure connection in communication with the intake region;

a control pressure chamber in communication with the control pressure connection;

a control piston disposed in the compressor housing beneath the control pressure chamber;

a guide element securing the control piston in the compressor housing;

at least one sealing element disposed between the control piston and the guide element;

a feed pressure connection defined in the compressor housing to supply compressed air beneath the control piston;

wherein the control piston is disposed in a closed position when the compressor arrangement is in operation and an opened position when the compressor arrangement is in a switched off state, wherein the control piston closes the feed pressure connection when in the closed position due to a greater pressure in the feed pressure connection than in the control pressure chamber, wherein the control piston opens the feed pressure connection when in the opened position due to a greater pressure in the control pressure chamber than in the feed pressure connection, thereby permitting air to vent from the feed pressure connection via a venting connection.

2. The compressor arrangement of claim 1, wherein the control piston defines an annular feed pressure face exposed to the air from the feed pressure connection upon which the air acts to close the control piston when the compressor arrangement is in operation.

3. The compressor arrangement of claim 2, wherein the control piston defines an annular control pressure face exposed to air from the control pressure chamber upon which the air acts to open the control piston when the compressor arrangement is in the switched off state.

4. The compressor arrangement of claim 3, wherein the annular control pressure face presents a surface area larger than a surface area of the feed pressure face so that approximately equal pressures in the feed pressure connection and in the control pressure connection bias the control piston in the opened position.

5. The compressor arrangement of claim 1, wherein the compressor housing forms the valve seat for the control piston.

6. The compressor arrangement of claim 1, wherein the guide element extends coaxially through the control piston, is threadedly connected to the compressor housing, and receives the sealing element therein.

7. The compressor arrangement of claim 1, further comprising a valve seat formed by at least one bore in the compressor housing, wherein the bore is concentric with the control pressure chamber.

8. The compressor arrangement of claim 7, further comprising a closing element disposed within the at least one bore, the closing element being removably disposed within the at least one bore.

9. The compressor arrangement of claim 1, further comprising an annular gap between the control piston and the guide element to permit venting when the control valve is in the opened position.

10. The compressor arrangement of claim 9, wherein the control piston defines radial bores therein, the radial bores forming venting ducts between the annular gap and the venting connection.

11. The compressor arrangement of claim 1, further comprising:

an air intake filter connected to the wherein the venting connection.

12. The compressor arrangement of claim 1, further comprising:

an air/oil separation element with a clean side, wherein the feed pressure connection connects to the clean side of an air/oil separation element.

* * * * *